US007600584B2

(12) United States Patent
Sewell et al.

(10) Patent No.: US 7,600,584 B2
(45) Date of Patent: Oct. 13, 2009

(54) PIPE HANDLING SYSTEM WITH A MOVABLE MAGAZINE

(75) Inventors: Cody L. Sewell, Perry, OK (US); Ricky G. Porter, Perry, OK (US); Adam R. Hall, Perry, OK (US)

(73) Assignee: The Charles Machine Works, Inc., Perry, OK (US)

( * ) Notice: Subject to any disclaimer, the term of this patent is extended or adjusted under 35 U.S.C. 154(b) by 251 days.

(21) Appl. No.: 11/627,804

(22) Filed: Jan. 26, 2007

(65) Prior Publication Data

US 2007/0119623 A1 May 31, 2007

Related U.S. Application Data

(63) Continuation-in-part of application No. 10/946,632, filed on Sep. 21, 2004, now Pat. No. 7,240,742.

(51) Int. Cl.
*E21B 19/14* (2006.01)

(52) U.S. Cl. ..... 175/52; 175/85; 166/85.1

(58) Field of Classification Search ..... 175/52, 175/85; 166/85.1; 414/22.62, 22.65
See application file for complete search history.

(56) References Cited

U.S. PATENT DOCUMENTS

| | | | | |
|---|---|---|---|---|
| 5,556,253 | A | 9/1996 | Rozendaal et al. | |
| 5,607,280 | A | 3/1997 | Rozendaal | |
| 5,954,209 | A | 9/1999 | Wurm et al. | |
| 6,074,153 | A | 6/2000 | Allen | |
| 6,085,852 | A | 7/2000 | Sparks et al. | |
| 6,179,065 | B1 | 1/2001 | Payne et al. | |
| 6,189,628 | B1 | 2/2001 | Jenne | |
| 6,298,927 | B1 * | 10/2001 | Back | 175/52 |
| 6,332,502 | B1 | 12/2001 | Mills et al. | |
| 6,419,029 | B2 | 7/2002 | Bayer et al. | |
| 6,533,046 | B2 | 3/2003 | Mills et al. | |
| 6,543,551 | B1 | 4/2003 | Sparks et al. | |
| 6,637,525 | B2 | 10/2003 | Watanabe et al. | |
| 6,814,164 | B2 | 11/2004 | Mills et al. | |
| 7,018,164 | B2 | 3/2006 | Anthis et al. | |
| 2002/0153169 | A1 | 10/2002 | Sewell | |

FOREIGN PATENT DOCUMENTS

| | | | |
|---|---|---|---|
| WO | 00/75479 | A1 | 12/2000 |
| WO | 01/33035 | A1 | 5/2001 |

OTHER PUBLICATIONS

Barbco, Inc. "Barbco Directional Drilling", cover of brochure, including nine (9) pages of photos of Barbco BD50-15SC model, 2001.

* cited by examiner

*Primary Examiner*—William P Neuder
(74) *Attorney, Agent, or Firm*—Tomlinson & O'Connell, PC

(57) ABSTRACT

A pipe handling assembly for transporting pipe sections to and from the drill string of a horizontal boring machine. The system comprises a magazine, a cradle for supporting the magazine, a support member, a drive system, and a transfer assembly. The drive system may move the cradle and the magazine laterally on the support member or may pivot the magazine. The transfer assembly transfers pipe sections between the magazine and the spindle connection area. The magazine and the support frame are disposed above the spindle connection area such that only empty columns of the magazine are outside of the footprint of the boring machine. The magazine may be removed from the cradle when empty or full to continue with the boring operation.

21 Claims, 15 Drawing Sheets

PIPE HANDLING SYSTEM WITH A MOVABLE MAGAZINE

CROSS REFERENCE TO RELATED APPLICATIONS

This application is a continuation-in-part of U.S. application Ser. No. 10/946,632, filed Sep. 21, 2004, the contents of which are incorporated herein fully by reference.

FIELD OF THE INVENTION

The present invention relates generally to the field of horizontal directional drilling, and in particular to pipe handling systems for loading and unloading pipes on a horizontal boring machine.

SUMMARY OF THE INVENTION

The present invention comprises a pipe handling device for storing and transporting pipe sections to and from a spindle axis of a horizontal boring machine. The pipe handling device comprises a support member having a first end and a second end, a discharge point at the first end of the support member, a magazine, and a transfer assembly. The support member is positioned such that the support member is located above the spindle axis and such that the first end is on a first side of the spindle axis and the second end is on a second side of the spindle axis. The magazine has a plurality of columns to receive and store pipe sections parallel to the spindle axis and is movable between a plurality of positions. The plurality of positions of the magazine are defined by the position of the magazine when different columns of the magazine are aligned with the discharge point. The support member prevents pipe sections from being discharged from each of the plurality columns that stores a pipe section and is not aligned with the discharge point. The transfer assembly is moveable between at least a first position and a second position. The transfer assembly comprises a pipe delivery member. In the first position the pipe delivery member is aligned with the discharge point and in the second position the pipe delivery member is aligned with the spindle axis.

In an alternative embodiment, the present invention comprises a pipe handling device for storing and transporting pipe sections to and from a spindle axis of a horizontal boring machine. The pipe handling device comprises a magazine, a base member, and a transfer system. The magazine has a first side, an opposed second side, and a plurality of adjacent columns to receive and store pipe sections including a first column immediately adjacent the first side. The magazine is moveable along a path of travel between an initial discharge position, in which the first column is aligned with a discharge point below the magazine, and a final discharge position, in which the column immediately adjacent the second side is aligned with the same discharge point. The path of travel of the magazine has a footprint which overlays the spindle axis over at least a portion of the path of travel. The base member is positionable beneath the magazine and has a blocking surface which blocks discharge of pipes from the base of the magazine in any column closer to the second side than the column aligned with the discharge point, while permitting a pipe in the column aligned with the discharge point to discharge from a base of the column and move to the discharge point. The transfer system is adapted to move a discharged pipe from the discharge point to the spindle axis.

In yet another embodiment the invention comprises a method for transferring pipe sections to a horizontal boring machine from a magazine having a plurality of adjacent columns for storing pipe sections. The method comprises moving the magazine such that a column of the magazine containing pipe sections is aligned above a discharge point, retrieving a pipe section from the discharge point, moving the retrieved pipe section to the horizontal boring machine while blocking further pipe sections from being discharged to the discharge point, and maintaining any columns having pipe sections within the tracks of the horizontal boring machine.

BRIEF DESCRIPTION OF THE DRAWINGS

FIG. 2 is a perspective view of a movable magazine for use with the pipe handling system of the present invention.

FIG. 6 is an elevation view of the pipe handling assembly of FIG. 4, with a lift arm of a dispensing assembly engaging the pipe sections.

FIG. 9 is an elevation view of the pipe handling assembly of FIG. 8, with the magazine moved to position a different column of pipe above the discharge point.

DETAILED DESCRIPTION OF THE PREFERRED EMBODIMENTS

Horizontal boring machines are used to install utility services or other products underground. Horizontal directional drilling eliminates surface disruption along the length of the project, except at the entry and exit points, and reduces the likelihood of damaging previously buried products. Skilled and experienced crews have greatly increased the efficiency and accuracy of boring operations. However, there is a continuing need for more automated boring machines which reduce the need for operator intervention and thereby increase the efficiency of boring underground.

The boring operation is a process of using a boring machine to advance a drill string through the earth along a desired path. The boring machine generally comprises a frame, a drive system mounted on the frame and connected to one end of the drill string, and a boring tool connected to the other end of the drill string. The drive system provides thrust and rotation needed to advance the drill string and the boring tool through the earth. The drill string is generally comprised of a plurality of drill pipe sections joined together at threaded connections. As the boring operation proceeds, the drill string is lengthened by repeatedly adding pipe sections from a pipe magazine to the drill string.

When the boring operation is completed, the drill string is pulled back through the borehole during a backreaming operation, generally with the utility line or product to be installed underground connected to the end of the drill string. During this backreaming operation, pipe sections are removed from the drill string as the drill string gets shorter. Each time a pipe section is taken from the drill string, the pipe section is replaced into the magazine. As is the case with the addition of pipe sections to the drill string, the process is repetitive. As one skilled in the art will appreciate, efficient and economic mechanisms for adding and removing pipe sections are a present need in the industry.

Figure 1:
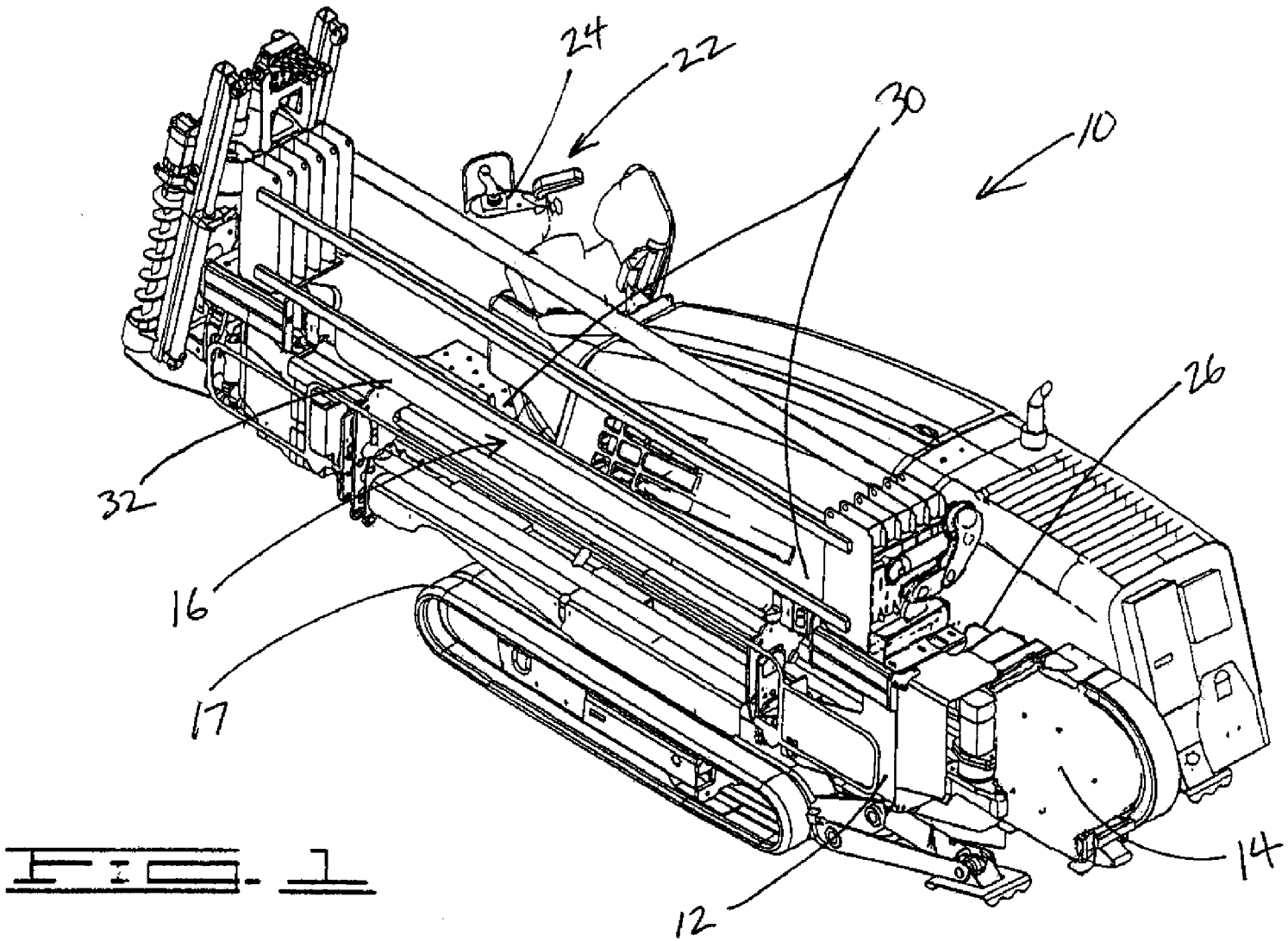
FIG. 1 is a perspective view of a horizontal boring machine with a pipe handling system in accordance with the present invention.

Turning now to the drawings in general and FIG. 1 in particular, there is shown therein a horizontal boring machine in accordance with the present invention. The boring machine, designated generally by reference numeral 10, generally comprises a frame 12, a drive system 14 supported on the frame, a pipe handling system 16 supported on the frame, a plurality of tracks 17, a drill string (not shown), and a directional boring tool (not shown). The boring machine 10 is operated and monitored with controls located at an operator's console 22. The operator's console 22 may contain a control panel 24 having a display, joystick, and other machine function control mechanisms, such as switches and buttons. From the control panel 24, each of the underlying functions of the boring machine 10 can be controlled. The display on the control panel 24 may include a digital screen and a plurality of signaling devices, such as gauges, lights, and audible devices, to communicate the status of the operations to the operator.

The drive system 14 is connected to the drill string by way of a spindle 26. The spindle 26 preferably comprises a threaded spindle pipe joint for connection to a threaded pipe joint on the end of a pipe section 28 (shown in FIG. 4). As used herein, a pipe joint can be either of the male or female threaded ends of a pipe section 28. One skilled in the art will appreciate that the drill string is formed of a plurality of individual pipe sections 28 connected together at threaded pipe joints.

As the boring machine 10 bores the borehole and the drill string is lengthened, additional pipe sections 28 are added or "made up." As part of the makeup operation, a pipe section 28 is transported to a spindle connection area 30 by a pipe handling assembly 32. The spindle connection area 30 represents the area of the boring machine 10 where the drive system 14 engages the pipe section 28 of the drill string. The drive system 14 moves and engages the pipe section along a spindle axis 34 (shown in FIG. 4). Other aspects of the machine 10 and operation not pertinent to the present invention function to lubricate and secure the pipe section 28 to the drill string. The boring operation can then continue by advancing the drill string 18 along a desired bore path.

When the boring operation is complete, the backreaming operation typically is performed. During the backreaming operation, pipe sections 28 are removed from the drill string or "broken out." As part of the breakout operation, other aspects of the machine 10 remove the pipe section 28 in the spindle connection area 30 from the drill string. The pipe section 28 is removed from the spindle connection area 30 by the pipe handling assembly 32. The backreaming operation can then continue by pulling the drill string back through the borehole.

Figure 3:
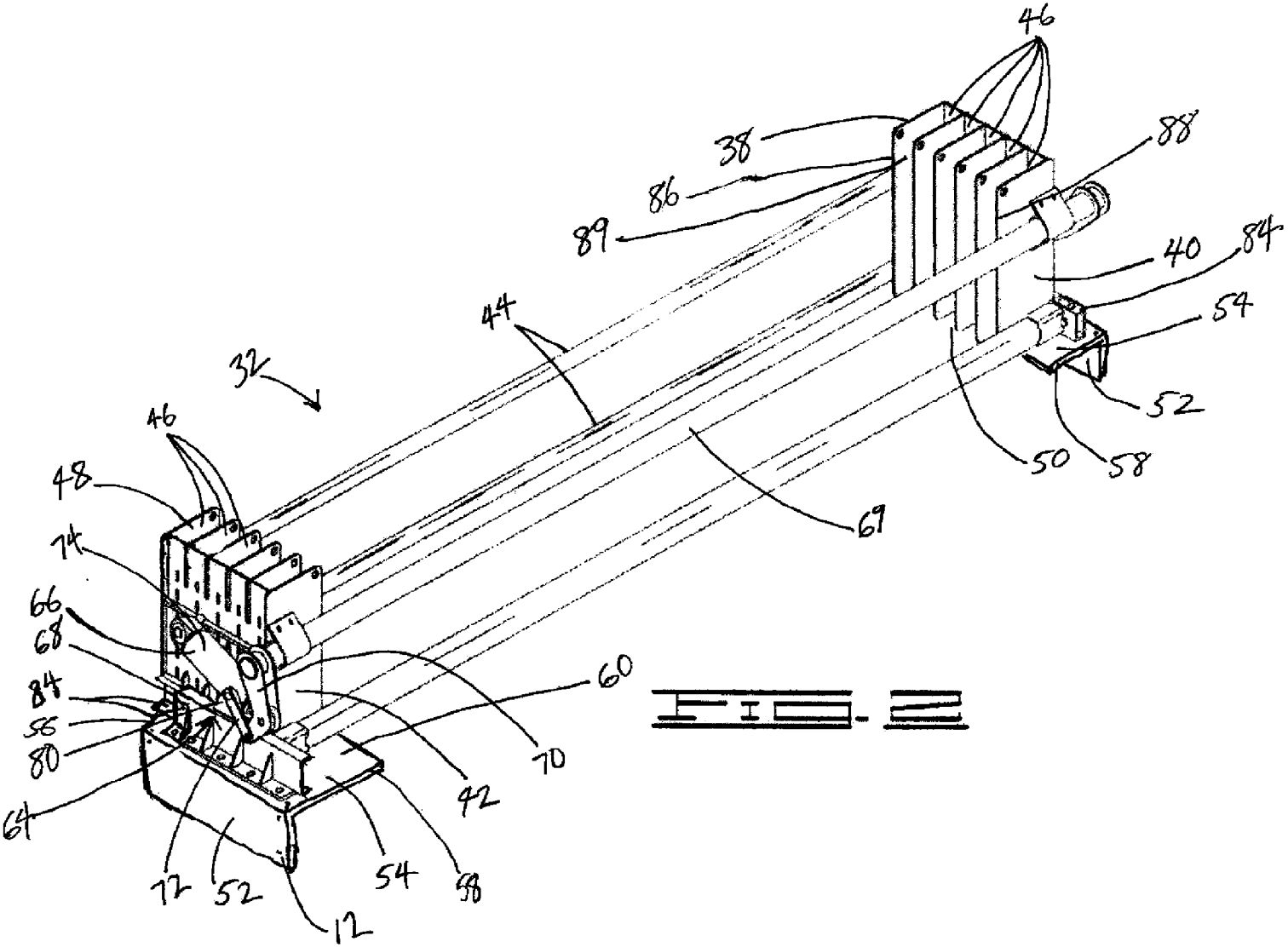
FIG. 3 is a perspective view of the transfer assembly for use with the pipe handling system of the present invention.
Figure 3:
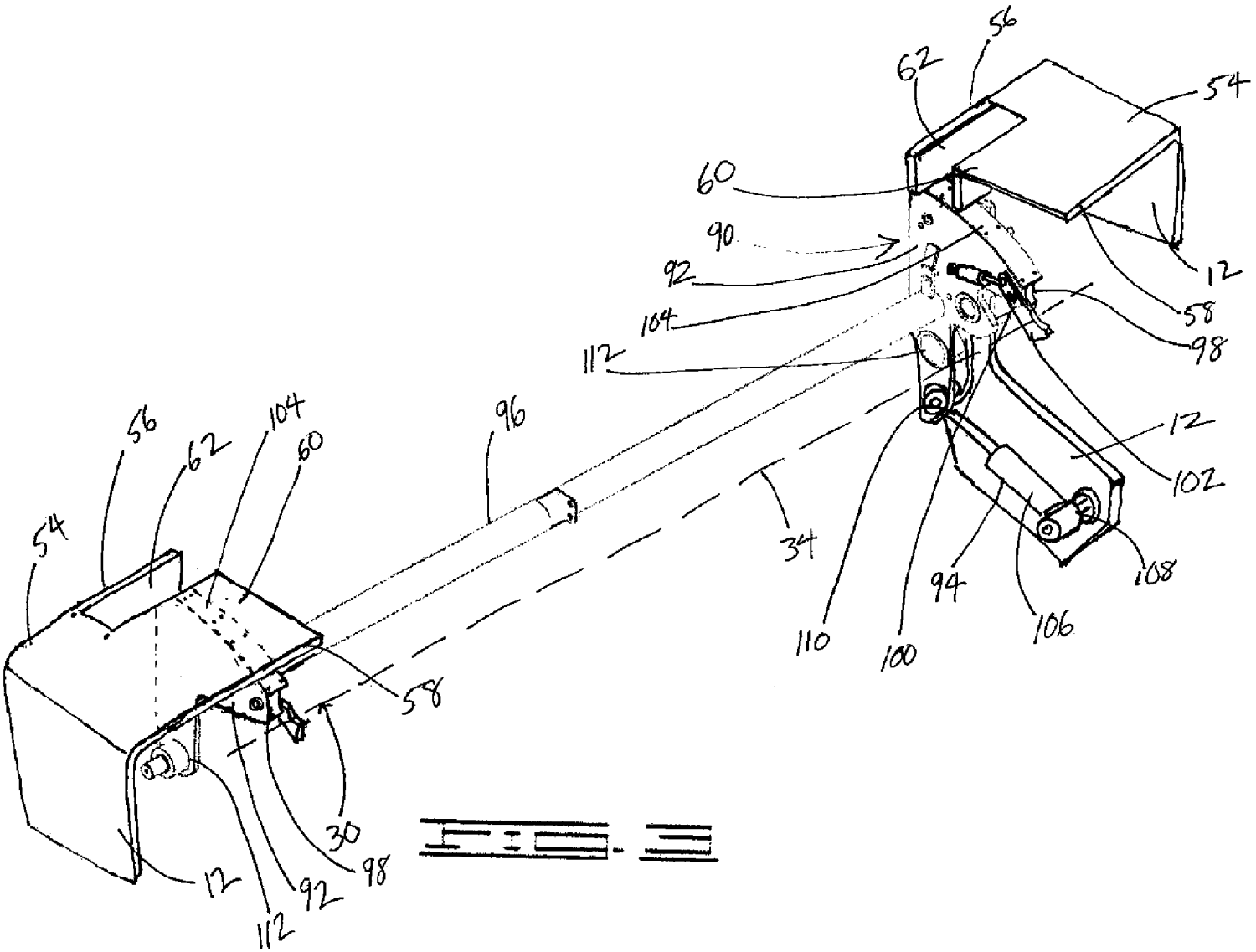

A preferred embodiment for the pipe handling assembly 32 of the present invention is shown in more detail in FIGS. 2 and 3. As shown therein, the pipe handling assembly 32 comprises a magazine 38 having a plurality of columns for storing and receiving pipe sections 28. The magazine 38 comprises first and second end pieces 40 and 42 joined by one or more cross bars 44. Each of the end pieces 40 and 42 is preferably shaped to form a plurality of channels 46. The opposing channels 46 in the end pieces 40 and 42 form the plurality of adjacent columns for storing the pipe sections 28. The cross bars 44 provide stability to the magazine 38 and keep the end pieces 40 and 42 aligned to form the columns for the pipe sections 28. The end pieces 40 and 42 each have an open top 48 and an open bottom 50, permitting pipe sections 28 to be placed in or removed from the magazine 38 through the top or bottom. Preferably, a plurality of retaining pins (not shown) are used to keep pipe sections 28 from being inadvertently discharged from the magazine 38.

Referring now to FIG. 3, the pipe handling assembly 32 further comprises a frame 52 having a support member 54 having a first end 56 and a second end 58 and which is positioned beneath the magazine 38. The support member 54 is preferably secured to the frame 12 of the boring machine 10. More preferably, the support member 54 is positioned above the spindle connection area 30 such that the first end 56 of the support member is on a first side of the spindle axis 34 and the second end 58 of the support member is on a second side of the spindle axis. The support member 54 further has a blocking surface 60 which blocks discharge of pipe sections 28 in columns directly above the support member. As to be discussed further below, a discharge point 62 is preferably located at the first end 56 of the support member 54 where pipe sections 28 are discharged from the magazine 38.

With reference again to FIG. 2, the pipe handling assembly 32 further comprises a drive system 64 operatively connected to the magazine 38 and adapted to move the magazine relative to the support member 54. As shown in the embodiment of FIG. 2, the drive system 64 comprises a linkage assembly 66 and a roller assembly 68. Preferably, the drive system 64 will comprise a linkage assembly 66 and a roller assembly 68 at each end of the magazine 38. In the preferred embodiment, a crossbar 69 operatively connects the linkage assembly 66 at each end of the magazine 38 to assist the coordinated movement of the magazine.

The linkage assembly 66 comprises a lever arm 70, a lever link 72 and a cylinder 74. The lever arm 70 has a first end pivotally attached to the magazine 38 and a second end connected to the lever link 72. The lever link 72 is connected between the second end of the lever arm 70 and the support member 54 or the frame 12 of the boring machine 10. The lever link 72 allows for adequate movement of the linkage assembly 66 and consequently the magazine 38. As shown in FIG. 2, the lever link 72 is connected to the support member 54 at an eyelet 80 attached to the support member 54. The cylinder 74 is attached at a first end to the magazine 38 and at a second end6 to the lever arm 70.

The roller assembly 68 facilitates movement of the magazine 38 relative to the support member 54. Preferably, the roller assembly 68 comprises a plurality of roller guides 84 and associated rollers. A set of roller guides 84 is preferably disposed at each end of the magazine 38. The set of roller guides 84 at each end of the magazine 38 comprises a roller guide secured to the support member 54 and a mated roller guide on the magazine 38. A plurality of rollers (not seen), such as ball bearings, are disposed within the set of roller guides 84. One skilled in the art will appreciate that as the cylinder 74 is extended or retracted the force from the cylinder will cause the magazine 38 to slide along the roller guide 84 attached to the support member 54.

In an alternative embodiment to be further described below, the mated roller guide attached to the magazine 38 in the embodiment of FIG. 2 can instead be secured to a cradle (see, for example, FIG. 12). The cradle would support the magazine 38, permitting the magazine to be removed when it is empty and replaced with a magazine full of pipe sections 28. Use of a cradle embodiment provides additional options for connection and operation of the drive system 64. One skilled in the art will appreciate the drive system 64 may be removably attached to the magazine 38, or may be operatively connected only to the cradle.

With continued reference to the embodiment shown in FIG. 2, operation of the drive system 64 serves to move the magazine 38 between a plurality of positions in which the plurality of columns of the magazine are aligned with the discharge point 62. With the magazine 38 above the support member 54, the discharge point 62 is preferably located at the first end 56 of the support member. A first side 86 of the magazine 38 is proximate the first end 56 of the support member 54 and an opposing second side 88 of the magazine is proximate the second end 58 of the support member. The magazine 38, then, has a first column 89 immediately adjacent the first side 86 of the magazine. Preferably, the path of travel of the magazine 38 includes an initial discharge position in which the first column 89 of the magazine is aligned with the discharge point 62. When pipe sections 28 in the first column 89 have been removed and added to the drill string 18, the magazine 38 is moved to another position in which a second column of the magazine, immediately adjacent the first column, is aligned with the discharge point 62. The movement of the magazine 38 is repeated as successive columns are emptied until a final discharge position is reached in which the column of the magazine immediately adjacent the second side 88 of the magazine is aligned with the discharge point 62. One skilled in the art will appreciate a footprint of the magazine overlays the spindle axis 34 over a least a portion of the path of travel if the support member 54 is positioned above the spindle axis as previously described. This path of travel also permits a more advantageous center of gravity of the boring machine 10, where the columns of the magazine 38 containing pipe sections 28 never extend beyond the tracks of the boring machine.

With reference now to FIG. 3, the pipe handling assembly 32 further comprises a transfer assembly 90 adapted to move a pipe section 28 between the discharge point 62 and the spindle connection area 30. Preferably, the transfer assembly 90 is adapted to move between at least a first position in which the transfer assembly is aligned with the discharge point 62 and a second position in which the transfer assembly is aligned with the spindle axis 34. The transfer assembly 90 comprises at least one transfer member 92 movably supported on the frame 12 and a drive assembly 94 for driving the movement of the transfer member. Where more than one transfer member 92 is used, a crossbar 96 or other linking structure can be used so the plurality of transfer members move in a coordinated fashion. Alternatively, separate drive assemblies could be used for the plurality of transfer members 92.

In the preferred embodiment shown in FIG. 3, the transfer member 92 comprises a pipe delivery member 98. The pipe delivery member 98 is adapted to receive and secure a pipe section 28 as the transfer assembly 92 moves between the first position and the second position. Preferably, the delivery member 98 further comprises a pipe grip 100 operatively connected to the pipe delivery member and adapted to secure the pipe section 28 on the pipe delivery member. More preferably, the pipe grip 100 comprises a hydraulically activated retaining arm 102. The arm 102 secures the pipe section 28 in the pipe delivery member 98 when the pipe section is transported between the discharge point 62 and the spindle connection area 30. In alternative embodiments (not shown) the pipe grip 100 may comprise a spring activated arm, a cam activated mechanism, or magnets to secure the pipe section 28 to the pipe delivery member 98.

The transfer member 92 further comprises a blocking surface 104. The blocking surface 104 is preferably adjacent the pipe delivery member 98 such that the blocking surface prevents discharge of pipes 28 from the magazine 38 and the discharge point 62 when the pipe delivery member is not aligned with the discharge point. Thus, when transfer member 92 is in the first position the pipe delivery member 98 is aligned with the discharge point 62. When the transfer member 92 is in the second position, the pipe delivery member 98 is aligned with the spindle axis 34 and the blocking surface 104 is aligned with the discharge point 62 to prevent discharge of pipe sections 28 from the magazine 38.

Figure 4:
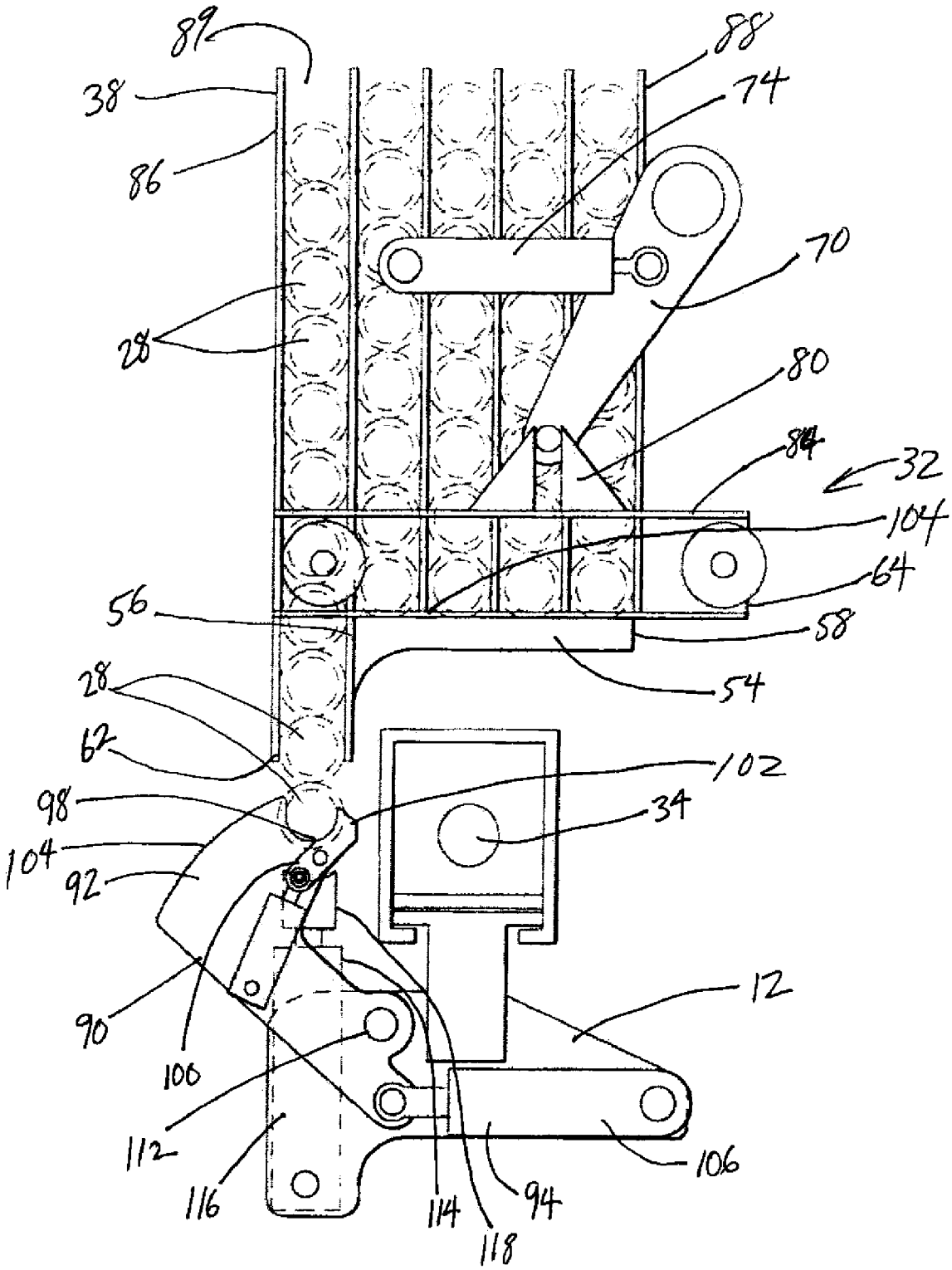
FIG. 4 is an end elevation view of the pipe handling assembly of the present invention, showing the transfer assembly in a first position at the discharge point.
Figure 5:
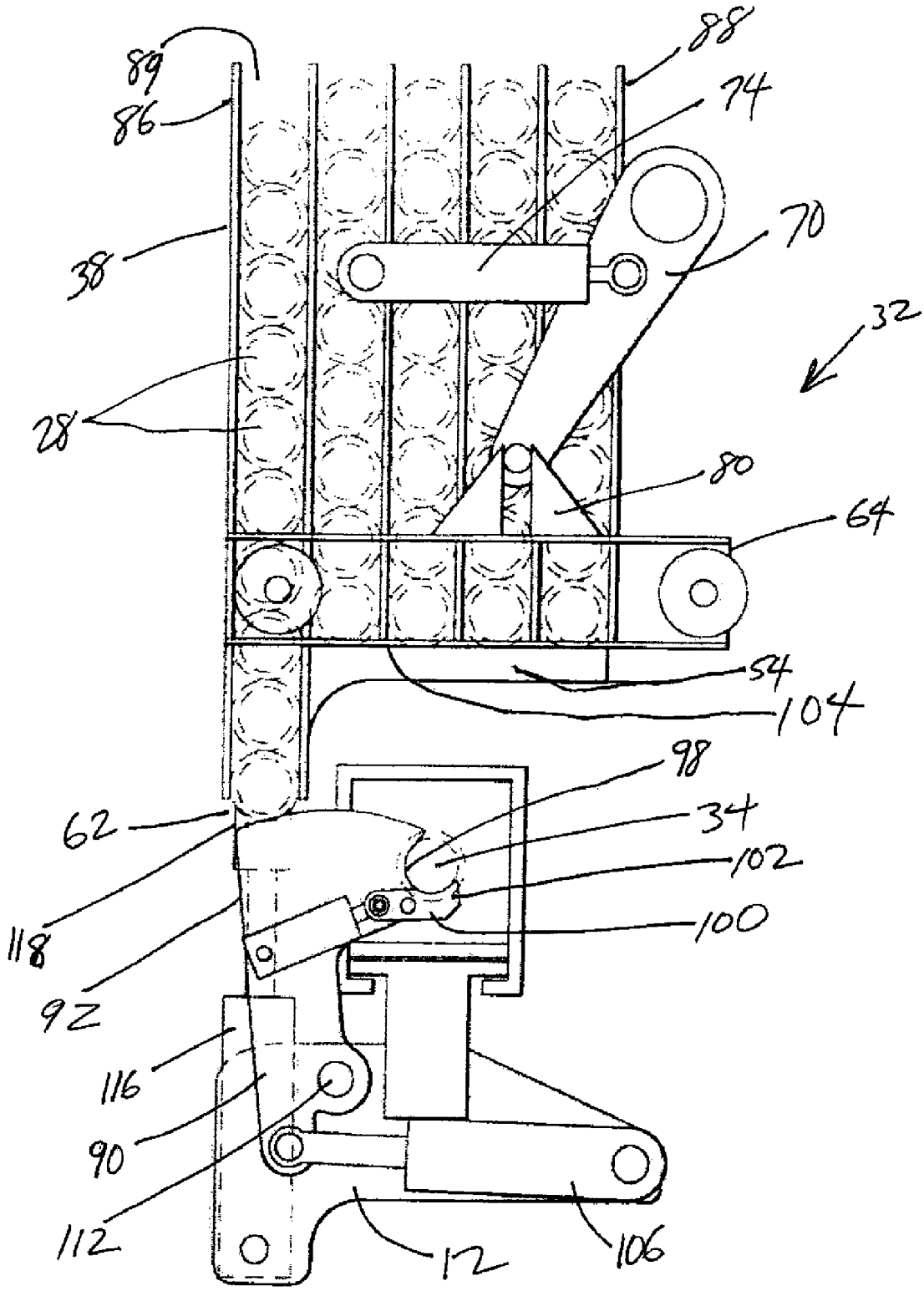
FIG. 5 is an elevation view of the pipe handling assembly of FIG. 4, with the transfer assembly in a second position and aligned with the spindle axis.
Figure 5:
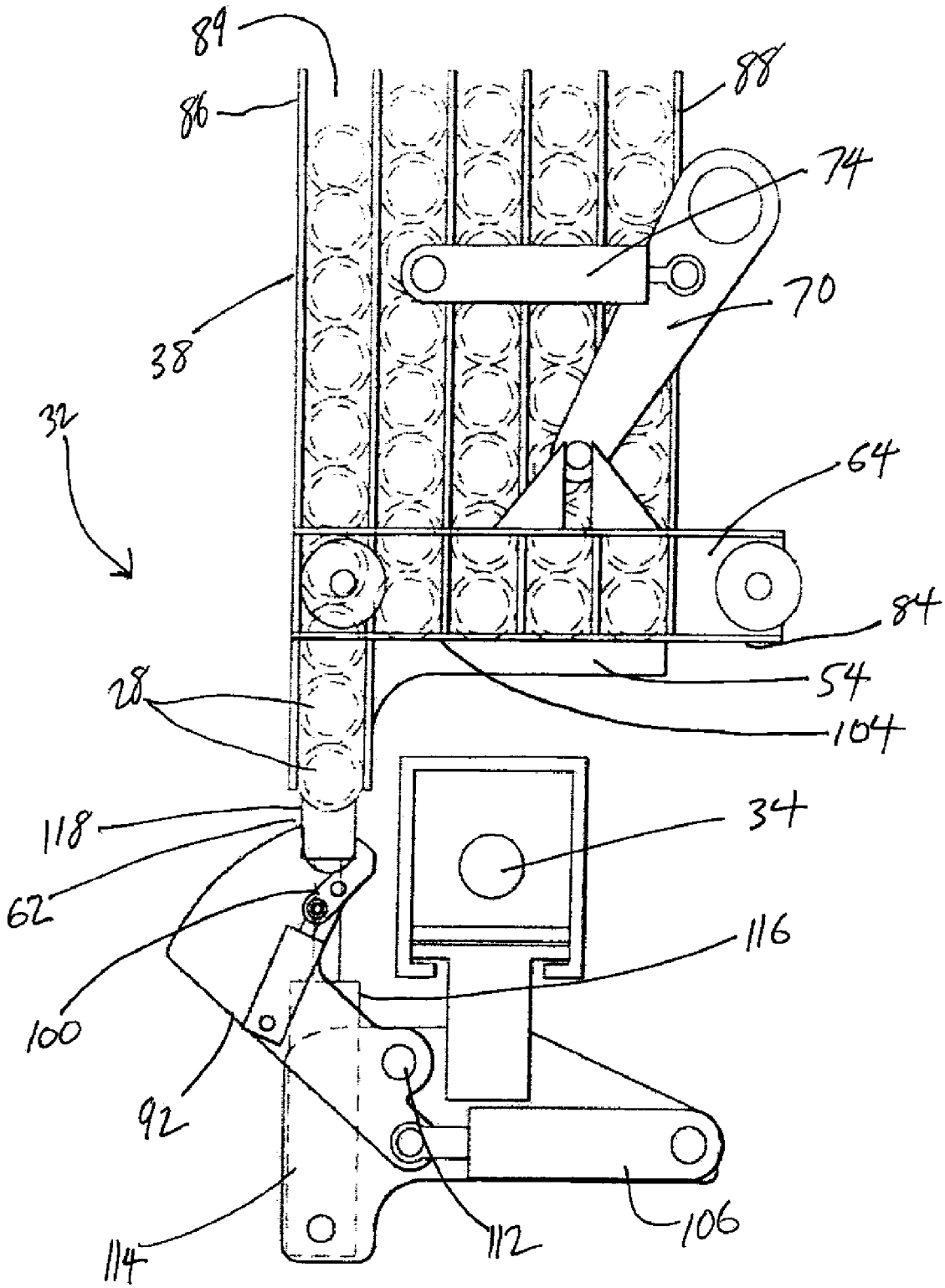

The drive assembly 94 is preferably a hydraulic cylinder 106 operatively connected to the transfer member 92. The hydraulic cylinder 106 is secured to the frame 14 at a first end 108 and to the transfer member 92 at a second end 110. In the preferred embodiment, the drive assembly 94 will operate to pivot the transfer member about a pivot point 112. As shown in FIG. 4, in the first position, the pipe delivery member 98 is aligned with the discharge point 62. With reference now to FIG. 5, the transfer member 92 is shown in the second position, with the pipe delivery member 98 aligned with the spindle axis 34 and the blocking surface 104 aligned with the discharge point 62. The hydraulic cylinder 106 is shown extended in FIG. 5, having caused the transfer member 92 to pivot about the pivot point 112.

With reference now to FIGS. 4 and 5, the pipe handling assembly 32 further comprises a dispensing system 114 adapted to limit and control discharge of pipes 28 at the discharge point 62 and to return pipes from the discharge point back to the magazine 38. The dispensing system 114 preferably comprises a hydraulic cylinder 116 and a lift arm 118 operatively connected to the cylinder. The lift arm 118 is movable between a plurality of positions by operation of the cylinder 116. In a lower position, as shown in FIG. 4, the lift arm 118 is retracted and does not contact any pipe sections 28. In a lift position, shown in FIG. 5, the lift arm 118 is extended to lift the pipe sections 28 from the discharge point 62 off of the transfer member 92. In this way the lift arm 118 functions to remove the added weight of pipe sections 28 from the blocking surface 104, limiting unwanted wear on the transfer member 92.

The lift arm 118 also may be used in this way to lower the next pipe section 28 from the magazine 38 into the pipe delivery member 98 at the discharge point 62. Referring now to FIG. 6, the transfer member 92 is shown in the first position, with the pipe delivery member 98 again aligned with the discharge point 62. Here, the pipe delivery member 98 is again positioned to receive a pipe section 28 from the discharge point 62 when the lift arm 118 is retracted, lowering the next pipe section to the delivery member. The position of the transfer member 90 in FIG. 6 could also represent use of the lift arm 118 to return a pipe section 28 that has been removed from the drill string 18 to the magazine 38. Thus, during the backreaming operation as the drill string 18 is shortened, the pipe delivery member 98 would transport a pipe section 28 from the drill string 18 at the spindle connection area 30 to the discharge point 62. The lift arm 118 would then be extended, to the position shown in FIG. 6 to return the pipe section 28 to the magazine 38.

Figure 7:
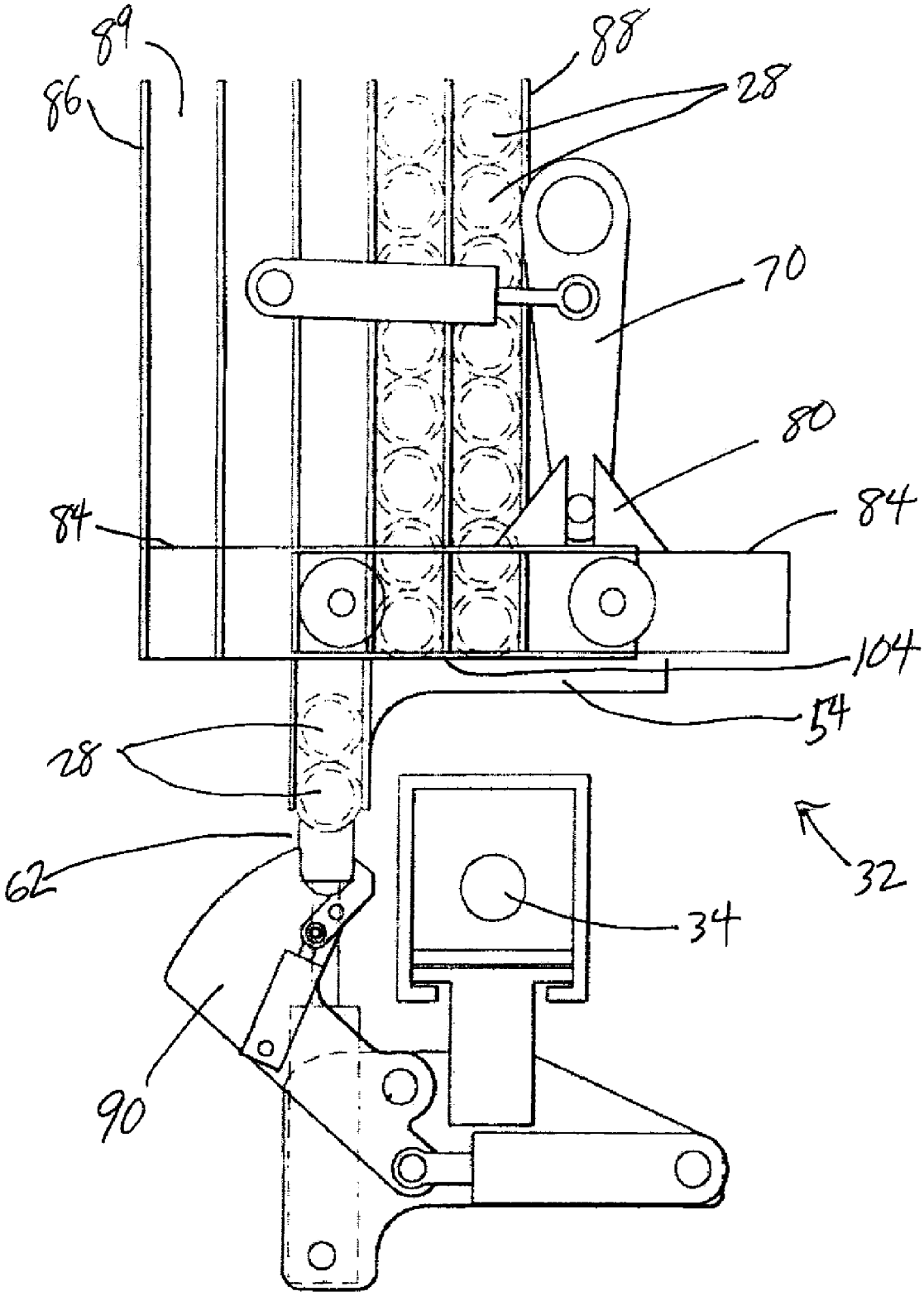
FIG. 7 is an elevation view of the pipe handling assembly of FIG. 4, with the magazine moved to position a different column of pipe above the discharge point.

As discussed previously, the transfer of pipe sections 28 between the magazine 38 and the spindle axis 34 can be repeated for each of the adjacent columns of the magazine. During a boring operation, as the drill string 18 is lengthened, the magazine 38 will be moved to a next fill column of the magazine as a column is emptied. Similarly, the magazine 38 will be moved to a next empty column of the magazine during the backreaming operation as pipe sections 28 are returned to the magazine. Referring now to FIG. 7, as an example, the magazine 38 is shown moved to a position along its path of travel where a middle column of the magazine is aligned with the discharge point 62.

Figure 8:
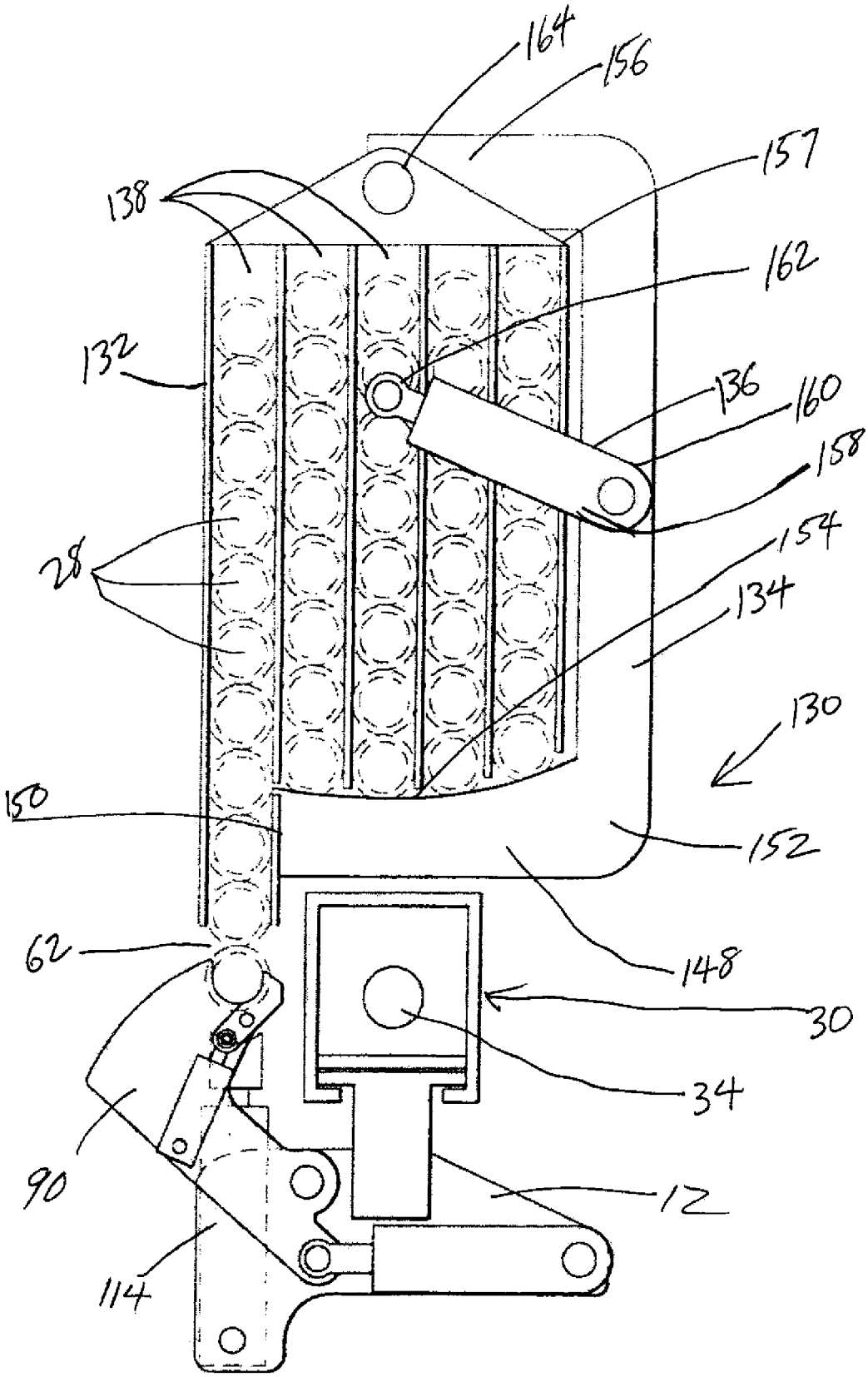
FIG. 8 is an alternative embodiment for the pipe handling assembly of the present invention.
Figure 3:
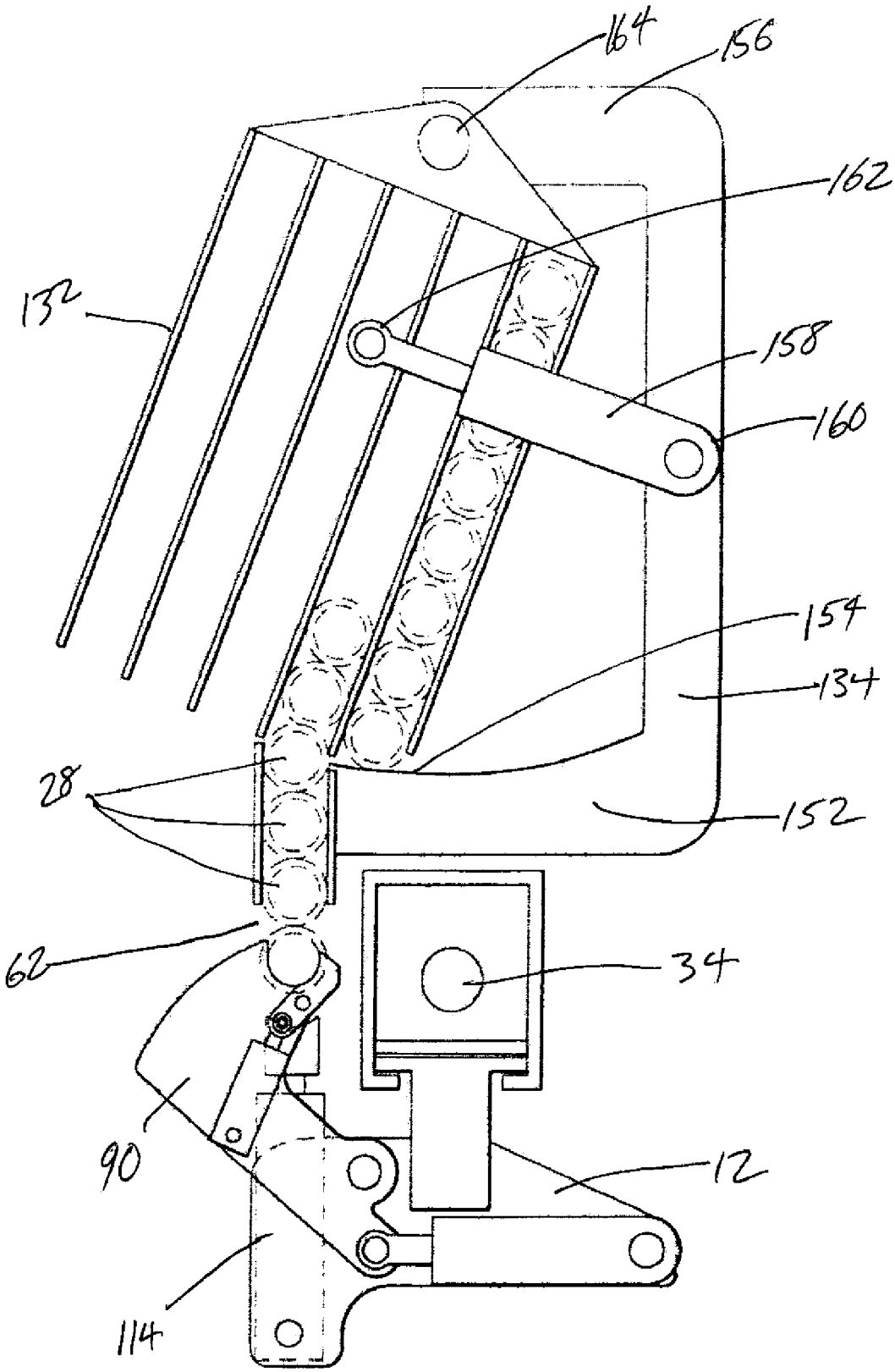

With reference now to FIG. 8, there is shown therein an alternative embodiment for the pipe handling assembly 130 of the present invention in which the magazine 132 is pivotally movable. In the alternative embodiment, the pipe handling assembly 130 comprises a magazine 132, a frame 134, and a drive system 136. The magazine 132 of the alternative embodiment has a plurality of adjacent columns 138 for storing and receiving pipe sections 28. The magazine 132 is similar to the magazine 38 of the embodiment shown in FIG. 2 and comprises first and second end pieces (not shown) joined by one or more cross bars (not shown). Each of the end pieces is preferably shaped to form a plurality of channels. The opposing channels in the end pieces form the plurality of adjacent columns 138 for storing the pipe sections 28. The end pieces again each have an open top and an open bottom, permitting pipe sections 28 to be placed in or removed from the magazine 132. Preferably, a plurality of retaining pins (not shown) are used to keep pipe sections 28 from being inadvertently discharged from the magazine 132 when not in use.

The frame 134 of the embodiment of FIG. 8 comprises a support member 148 having a first end 150 and a second end 152 and which is positioned beneath the magazine 132. Preferably, the support member 148 is positioned above the spindle connection area 30 such that the first end 150 of the support member is on a first side of the spindle axis 34 and the second end 152 of the support member is on a second side of the spindle axis. The support member 148 further has a blocking surface 154 which blocks discharge of pipe sections 28 in columns directly above the support member.

The frame 134 further comprises a magazine brace 156. The brace 156 is connectable to the magazine 132 such that the magazine is movably supported by the brace. As depicted in FIG. 8, the brace 156 is preferably connected to the magazine 132 proximate the top 157 of the magazine. The frame 134, including the support member 148 and the brace 156, are shown in a "C" shape, however any configuration for the frame with the support member below the magazine 132 and the brace pivotally supporting the magazine would be appropriate.

The drive system 136 is adapted to pivotally move the magazine 132. Preferably, the drive system 136 comprises a hydraulic cylinder 158. The cylinder 158 is attached at a first end 160 to the frame 134 of the pipe handling assembly 130 and at a second end 162 to the magazine 132. As the cylinder 158 extends and retracts, the magazine 132 is pivoted about a pivot point 164 where the magazine is supported at the brace 156. With reference now to FIG. 9, the magazine 132 is shown having been moved to a position in which another column of the magazine is aligned with the discharge point 62. Alternate drive systems for moving the magazine or the transfer arm include air, electric, ball screw or rack and pinion.

Figure 10:
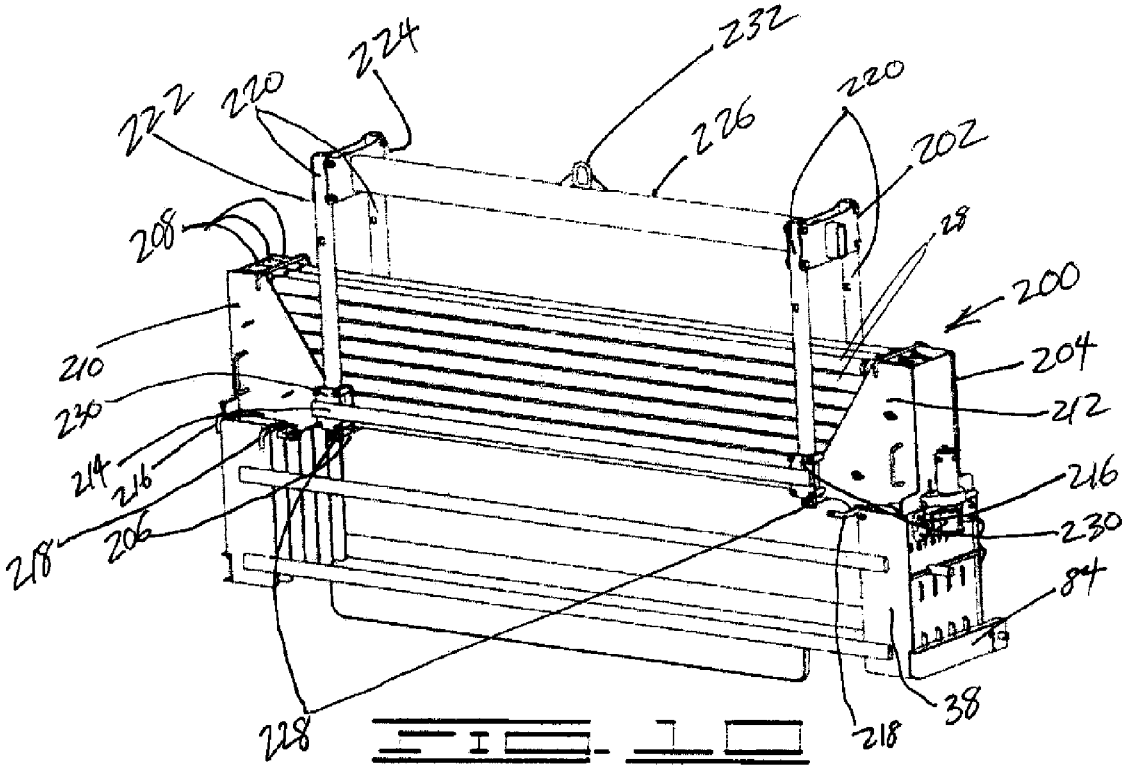
FIG. 10 is a perspective view of an auxiliary pipe assembly for use with the present invention.

With reference now to FIG. 10, the present invention also comprises an auxiliary pipe assembly 200 for providing additional pipe sections 28 to the pipe handling assembly 32. The auxiliary pipe assembly 200 comprises a movable load frame 202 and a cartridge 204 which store and transfer additional pipe sections 28 to and from the magazine 38. Preferably, the auxiliary pipe assembly 200 is adapted to be placed on top of the magazine 38 such that the columns of pipe sections 28 in the pipe cartridge 204 and load frame 202 are aligned with columns of the magazine. Alternatively, the auxiliary pipe assembly 200 may be adapted to transfer pipe sections 28 directly to and from one or more columns of the magazine 38. The auxiliary pipe assembly 200 of FIG. 10 is shown for use with the magazine 38 of the embodiment of FIG. 2, but the auxiliary pipe assembly could be used with any movable magazine. Other assemblies and methods of adding additional pipe sections to pipe handling systems are anticipated, including various replacement cartridges that can be placed on the moving pipe dispensing mechanism.

The cartridge 204 defines an open bottom 206 and a plurality of columns 208 to receive and store pipe sections 28. More preferably, the cartridge comprises opposing first and second end pieces 210 and 212 having column separators. One or more cross bars 214 are used to connect the first and second end pieces 210 and 212 and to provide stability for the cartridge 204. The cartridge 204 preferably comprises at least one securing pin 216 to maintain the cartridge in a position on top of the magazine 38. A plurality of retaining pins 218 may also be used proximate the bottom of the cartridge 204 to retain pipe sections 28 in the cartridge. In this way, the cartridge 204 may be used to store pip sections 28 remote from the boring machine 10 and the entire cartridge positioned on top of the magazine 38 when additional pipe sections are desired.

The load frame 202 comprises a plurality of guide posts 220 disposed to form a first 222 and a second side 224 of the load frame. Preferably, a pair of laterally spaced guide posts 220 are used for each the first side 222 and the second side 224 of the load frame 202. A top cross brace 226 joins and provides separation for the pairs of guide posts 220. A plurality of removable bottom support pins 228 connect guide posts 220 on the first side 222 and second side 224 of the load frame 202. The guide posts 220, cross brace 226, and support pins 228 form an open box configuration for the load frame 202.

The load frame 202 is disposed around the plurality of pipe sections 28 to be added to the magazine 38. In the preferred embodiment, the load frame 202 is disposed around the pipe sections 28 maintained in the cartridge 204. Preferably, the guide posts 220 of the load frame 202 are slidably supported by the cross bars 214 of the cartridge 204. More preferably, a plurality of slide channels 230 that receive the guide posts 220 may be secured to the cross bars 214 of the cartridge 204. The slide channels 230 permit the guide posts 220, and consequently the load frame 202, to slide vertically relative to the cartridge 204. Thus, if the retaining pins 218 are removed from the cartridge 204, the load frame 202 may be slidably lowered to lower the pipe sections 28 through the bottom 206 of the cartridge 204.

Figure 11:
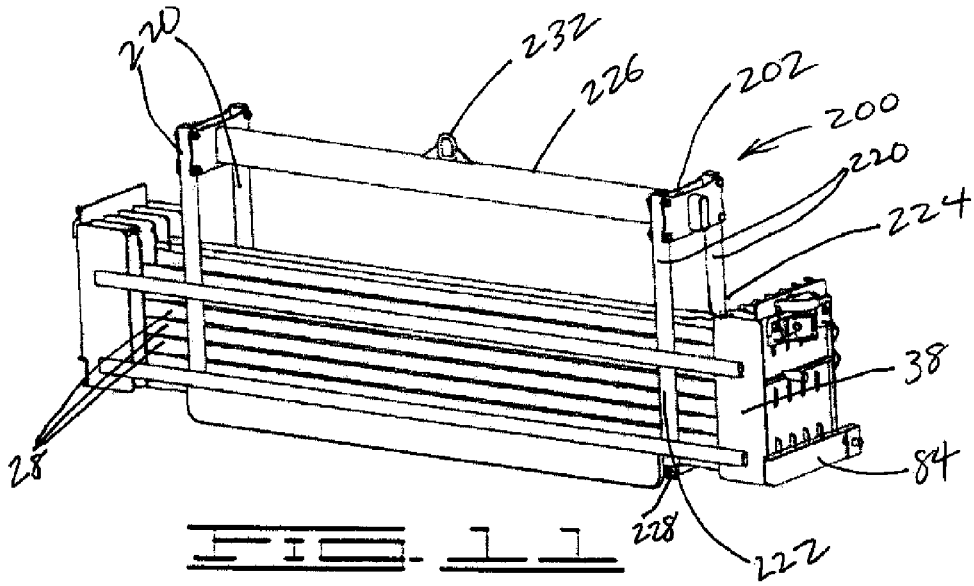
FIG. 11 is a perspective view of an alternative embodiment for an auxiliary pipe assembly for use with the present invention.

Although the load frame 202 is shown here for use with the cartridge 204, the load frame may also be used to load or remove at least one column of pipe sections 28 in the magazine 38 without the cartridge 204. FIG. 11, for example, shows the load frame 202 with pipe sections 28 positioned with the pipe sections added to the magazine 38. The application of FIG. 11 for the load frame 202 is also applicable for other columnar arrangements. The guide posts 220 may, for example, be separated by a distance sufficient enough to support only a single column of pipe sections 28. The column of pipe sections 28 could then be lowered into any chosen empty column of the magazine 38. Alternatively, the guide posts 220 may support a plurality of adjacent columns of pipe sections 28. The load frame preferably would have at least one spacer (not shown) to maintain the integrity of the columns. The plurality of columns can likewise be added to empty columns in the magazine 38, or removed from a plurality of full columns in the magazine.

As yet another alternative, the load frame 202 may support a plurality of columns not immediately adjacent to each other. The load fame 202 preferably comprises a plurality of interior post supports (not shown) to support and maintain the plurality of pipe sections in columnar fashion. The interior post supports would be disposed to maintain, for example, a column of pipe sections 28 immediately adjacent the first side 222 of the load frame 202. Other interior post supports would maintain a column immediately adjacent the second side 204 of the load frame 202. The plurality of columns could be separated by a distance equal to one or more unused columns.

The movement of the load frame 202 is preferably controlled by an external device or an assembly formed as part of the auxiliary pipe assembly 200. For example, an external crane (not shown) could be secured to a hook 232 on the cross brace 226 of the load frame 202 to lower the load frame and pipe sections 28 into the magazine 38. Alternatively, one or more hydraulic cylinders (not shown) or other mechanisms may be operatively connected to the guide posts 220 to slidably move the guide posts relative to the cartridge 204. One skilled in the art will appreciate that when the cartridge 204 and load frame 202 are placed on top of the magazine 38 or the cradle as previously described, the pipe sections 28 in the auxiliary pipe assembly can be transferred to the magazine.

Another method of transferring pipe sections 28 from the ground or from a trailer with the auxiliary pipe assembly 200 is with an integrally mounted lifting device. A crane like lifting device may consist of a single arm or a plurality of spaced apart telescoping arms protruding from the frame 12. The arms may move vertically from a lowered pickup point to a lifted delivery point above the magazine or cradle. The plurality of lift arms are spaced apart a distance greater than the length of the magazine allowing the auxiliary pipe assembly 200 to swing between the arms into position and to be lowered onto the magazine 38. The telescoping and lifting action are preferably accomplished with hydraulic cylinders. It is understood the same lifting device could be used for picking up and transferring the auxiliary system from the boring machine 10 onto either a trailer or the ground beside the machine.

Figure 12:
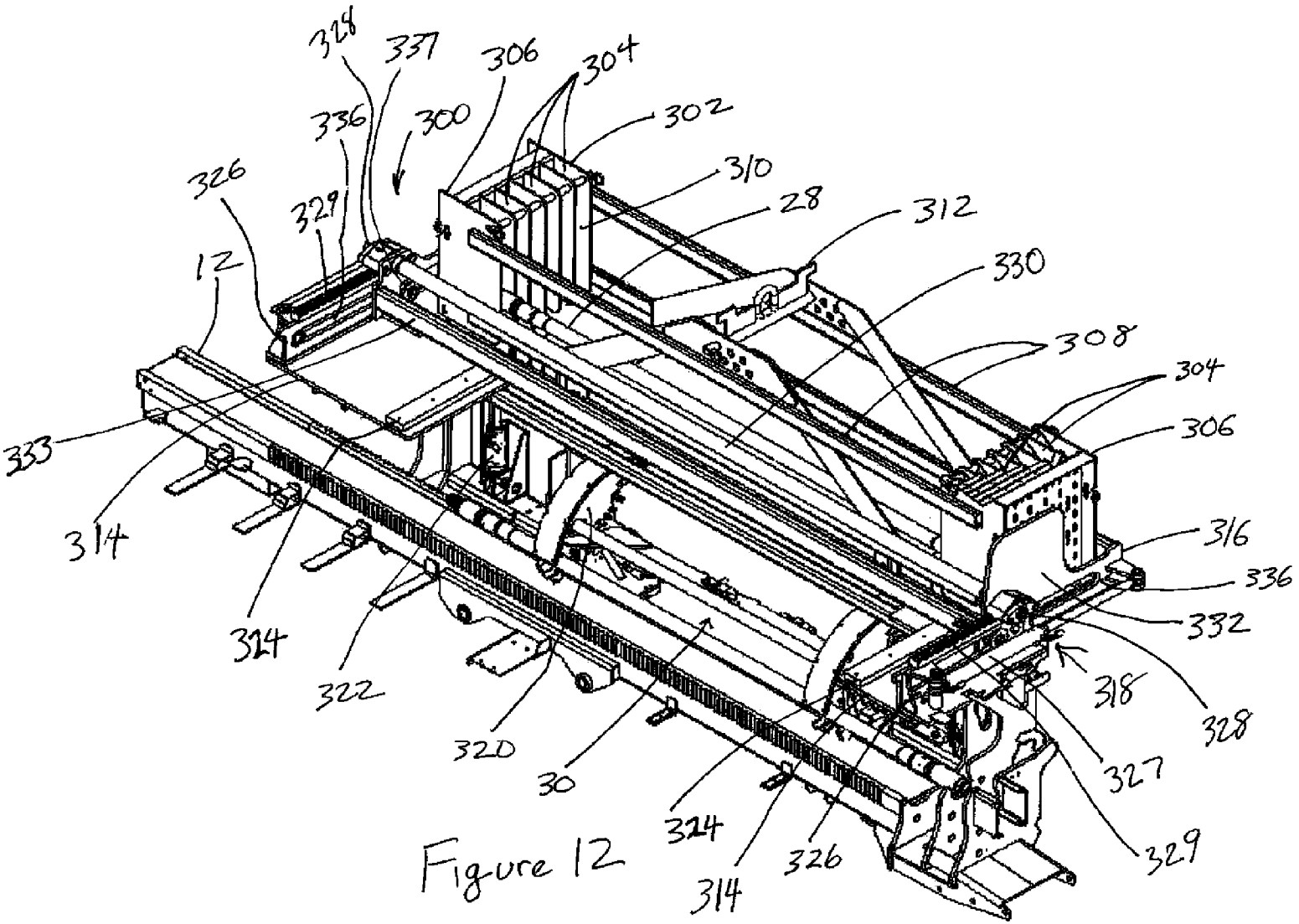
FIG. 12 is a perspective view of an embodiment for a removable magazine and pipe handling assembly.

With reference now to FIG. 12, there is shown therein an alternative embodiment for a pipe handling assembly 300 for use with a removable magazine 302. The removable magazine 302 defines a plurality of columns 304 for storing and receiving pipe sections 28. The magazine 302 comprises first and second end pieces 306 preferably joined by one or more cross bars 308. The end pieces 306 each define a plurality of channels 310. The opposing channels 310 in the end pieces 306 form the plurality of columns 304 for storing the pipe sections 28. The removable magazine 302 further comprises at least one lift bracket 312. The lift bracket 312 is preferably adapted to allow the removable magazine 302 to be lifted from the pipe handling assembly 300 and replaced with another like magazine. The end pieces 306 each have an open top and an open bottom, permitting pipe section 28 to be placed in or removed from the magazine 302 through the top or bottom. Retaining pins (not shown) may be used in a known manner to keep pipe sections 28 in the magazine 302 during transport of the magazine.

In the present embodiment, the pipe handling assembly 300 further comprises a frame 314 attached to the frame 12 of the boring machine 10, a cradle 316 adapted to support the removable magazine 302, a drive system 318 adapted to move the cradle relative to the frame, a transfer assembly 320, and a dispensing system 322. The transfer assembly 320 and the dispensing system 322 of the present embodiment is preferably constructed and may operate in substantially the same manner as the transfer assembly 90 and the dispensing system 114 discussed in the embodiments of FIGS. 3 and 4.

The frame 314 comprises a support member 324 positioned above the spindle connection area 30 and a roller guide 326. The roller guide 326 is attached to the support member 324 and adapted to provide structure for the movement of the cradle 316 relative to the frame 314. Preferably, two support member 324 and roller guide 326 pairs are used, disposed at opposite ends of the spindle connection area 30. As with the frame 54 of the embodiment of FIGS. 2 and 3, the discharge point 62 is located at an end of the support members 324. The support members 324 provide a blocking surface to prevent pipe sections 28 from being discharged from the magazine 302 when a column 304 of the magazine is positioned above the support members. When a column of the magazine 302 containing pipe sections 28 is above the discharge point 62, pipe sections 28 are discharged from the removable magazine 302 to the transfer assembly 320. The transfer assembly 320 then operates to receive a pipe section 28 from the discharge point 62 and move the pipe section to the spindle axis 34.

The drive system 318 operates to move the cradle 316, and consequently the removable magazine 302, relative to the frame 314. The drive system 318 is adapted to move the cradle 316 so that columns 304 of the magazine 302 can be positioned above the discharge point 62. In the preferred embodiment, the drive system 318 comprises at least one hydraulic cylinder 327. The hydraulic cylinder 327 is secured at a first end to the frame 314 and at a second end to the cradle 316. Extension and retraction of the cylinder 327 will cause the cradle 316 to be moved relative to the frame 314. Preferably, a pair of hydraulic cylinders 327 are used, one disposed at each end of the cradle 316. More preferably, the drive system 318 will also comprise a rack and pinion arrangement to help maintain the alignment of the cradle 316 as it moves. A pinion gear 328 attached to the cradle 316 interfaces with a rack 329 attached to the roller guide 326 of the frame 314. Preferably, the pinion gear 328 and rack 329 pair is disposed at each end of the cradle 316 and frame 314. More preferably, a torque arm 330 is disposed to connect the pair of pinion gears 328 to allow for coordinated rotation of the gears and movement of the cradle 316.

Figure 13:
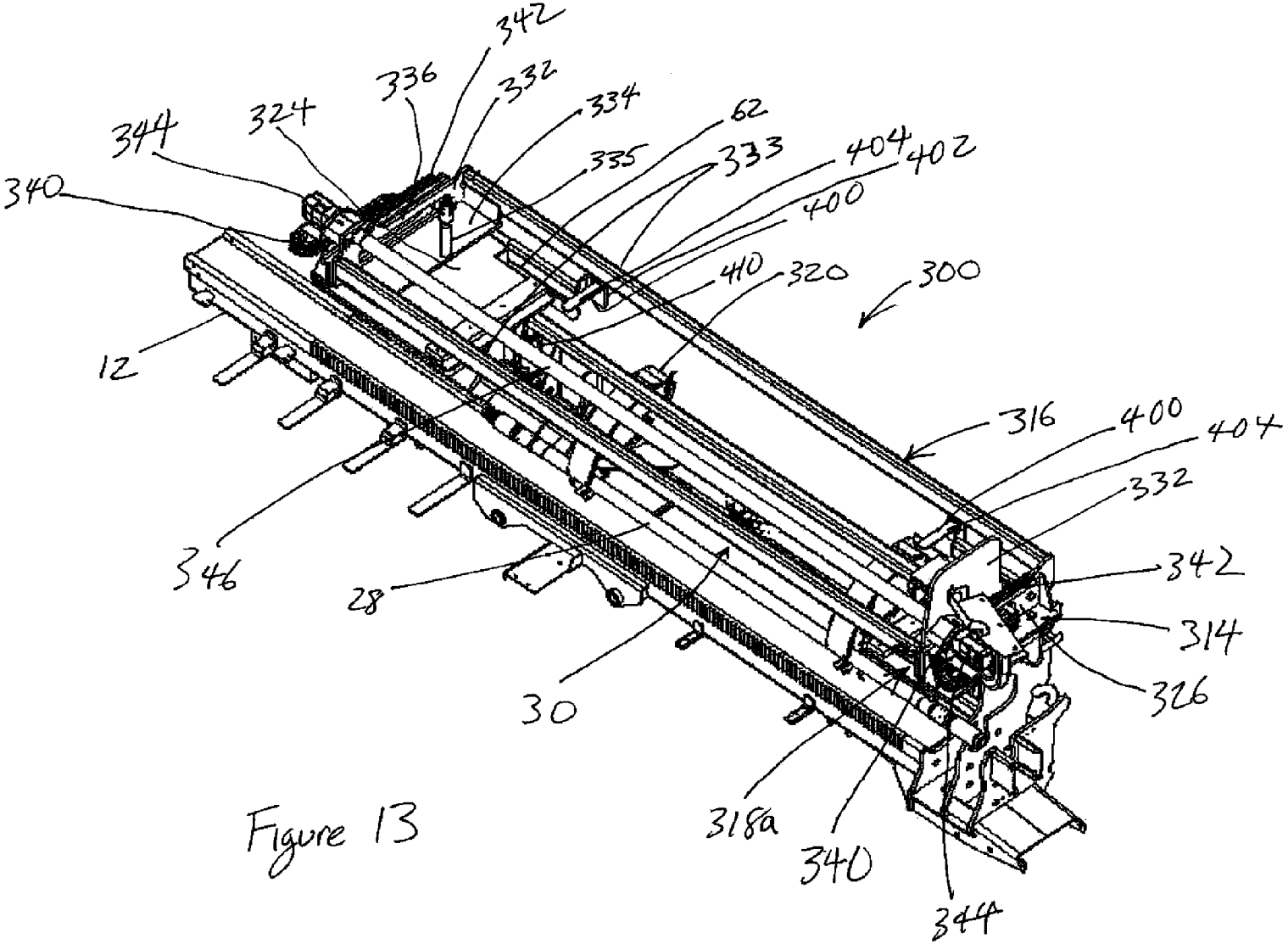
FIG. 13 is a perspective view of an alternative embodiment for moving the removable magazine of FIG. 12.

Referring now to FIG. 13, the cradle 316 is shown in greater detail, with the magazine 302 removed from the cradle. The cradle 316 is adapted and sized to receive and support the removable magazine 302. The cradle 316 preferably comprises a pair of end supports 332 connected by one or more connecting bars 333. The end supports 332 provide a surface 334 for the end pieces 306 of the removable magazine 302 to rest on. The cradle 316 may comprise at least one pin holder 335 or other attachment mechanisms to secure attachment of the removable magazine 302 to the cradle. The end supports 332 also provide a guide surface 336 to mate with the roller guides 326 on the frame 314 and provide for guided movement of the cradle 316 relative to the frame. Preferably, roller wheels 337 (shown in FIG. 12) disposed on the guide surface 336 will travel along a guide slot 338 (see FIG. 12) defined by the roller guides 326.

With continued reference to FIG. 13, an alternative embodiment for the drive system 318*a* is shown. The drive system 318*a* comprises a powered rack and pinion arrangement. As shown, a pinion gear 340 is attached to each of the end supports 332 of the cradle 316 and a rack 342 is attached to each of the roller guides 326 of the frame 314. Drive motors 344, attached to the cradle 316 and operatively connected to the pinion gears 340, provides power to rotate the gears. Preferably, a torque arm 346 is disposed to connect the pair of pinion gears 340 to allow for coordinated rotation of the gears. As the pinion gears 340 are rotated and move along the racks 342, the cradle 316 is moved relative to the frame 314.

Figure 14:
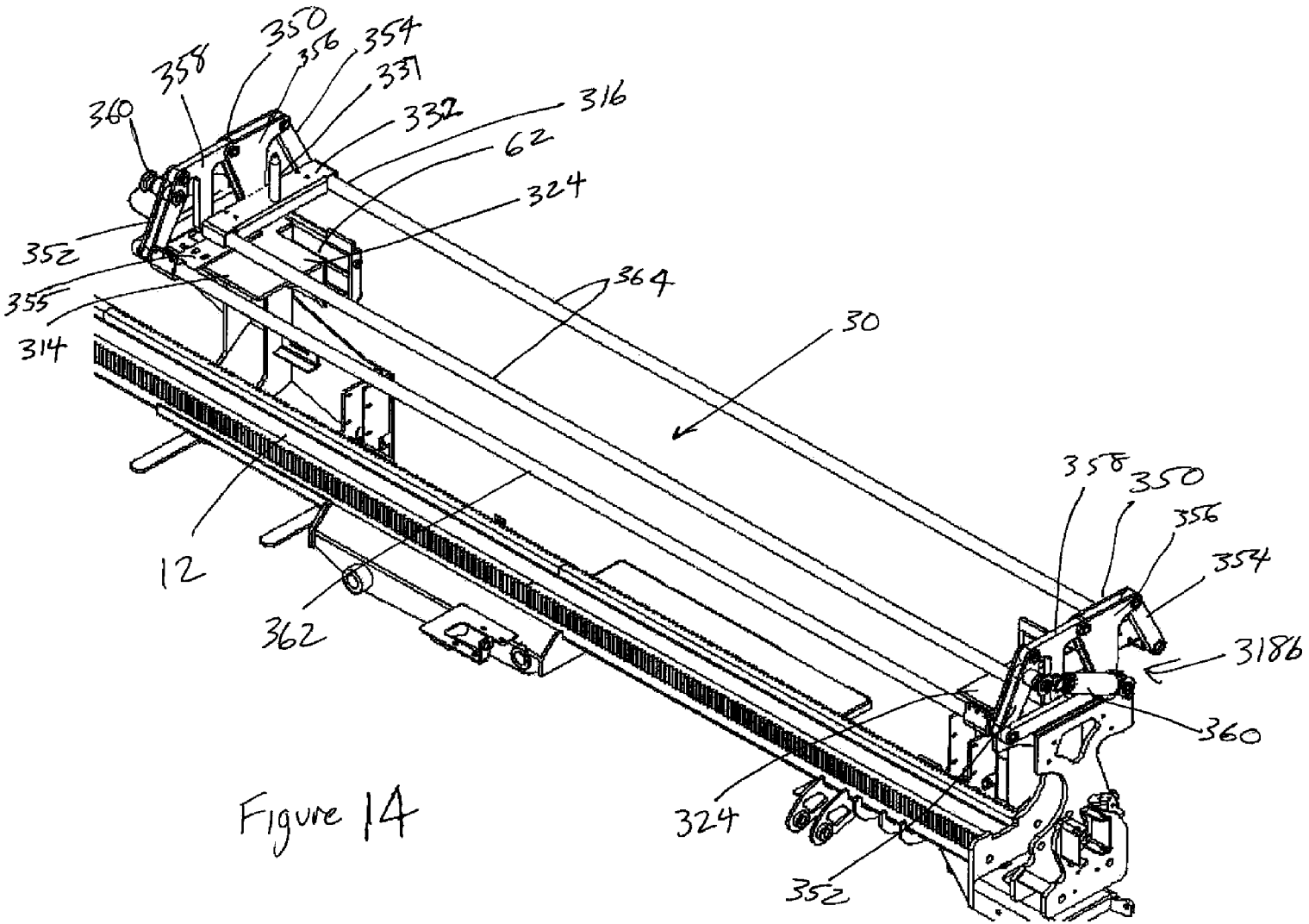
FIG. 14 is an alternative embodiment for the pipe handling assembly of FIG. 12.

Referring now to FIG. 14, there is shown therein an alternative drive system 318*b* for use with the pipe handling assembly 300. FIG. 14 shows the magazine removed. The drive system 318*b* moves the cradle 316 relative to the support member 324 using a six bar linkage assembly 350 that approximates linear movement. Preferably, the linkage assembly 350 comprises two interacting four bar linkages with similar proportions operatively connected to the support member 324 and the cradle 316. More preferably, the linkage assembly 350 comprises a plurality of links with pivoting pin connections for ease of movement. The linkage assembly 350 as described below provides for both the support and movement of the cradle 316 and will allow the cradle 316 to support the removable magazine 302 as the magazine travels beyond the frame 314 and the boring machine 10.

A frame link 352 is connected at a bottom end to the frame 314 and a cradle link 354 is connected at a bottom end to the cradle 316. Preferably, the frame link 352 is connected to an end of the frame 314 remote from the discharge point 62. More preferably, a frame extension 355 may be used to connect the frame link 352 to the end of the frame 314, providing added stability to the pipe handling assembly 300 when the weight of the magazine 302 and pipe sections 28 are added. An intermediate frame link 356 is connected at a bottom end to the frame 314 and an intermediate cradle link 358 is connected at a bottom end to the cradle 316. A top end of the frame link 352 is connected to a top end of the intermediate cradle link 358. A top end of the cradle link 354 is connected to a top end of the intermediate frame link 356. The top end of the intermediate cradle link 358 and the top end of the intermediate frame link 356 are also pivotally connected to each other. A hydraulic cylinder 360 is connected between the frame 314 and the top end of the frame link 352. Extension and retraction of the cylinder 360 causes the linkage assembly 350 to move the cradle 316 relative to the frame 314.

Preferably, the linkage assembly 350 is used in conjunction with a like assembly 350 at an opposite end of the spindle connection area 30 to allow for synchronized and smooth movement of the end supports 332 of the cradle 316. A plurality of torsion members are used to connect the pair of linkage assemblies 350. Preferably, a frame torsion tube 362 is disposed to connect between the bottom end of the frame links 352. More preferably, a pair of cradle torsion tubes 364 are disposed to connect the end supports 332 of the cradle 316. The cradle torsion tubes 364 may serve as the connecting bars 333 for the cradle 316.

Other embodiments for the drive system 318 are also anticipated. For example, the cradle 316 can be moved relative to the frame 314 using a linkage assembly 90 such as that disclosed above with reference to FIG. 2.

With reference again to FIG. 13, the pipe handling assembly 300 further comprises a supplementary blocking member 400 for use with the removable magazine 302. One skilled in the art will appreciate the use of retaining pins (not shown) to keep pipe sections 28 in the removable magazine 302 when the magazine is transported to or from the pipe handling assembly 300 with pipe sections 28 in the magazine. When the magazine 302 containing pipe sections 28 is placed in the cradle 316, pipe sections in columns positioned above the support members 324 are supported by the support members. Pipe sections 28 in a column over the discharge point 62, however, would still be supported by the retaining pins. The supplementary blocking member 400 provides support for the pipe sections 28 in the column over the discharge point 62, so that the retaining pins can be removed or inserted.

In the preferred embodiment, a pair of supplementary blocking members will be used, one at each end of the pipe handling assembly 300. The supplementary blocking members 400 comprise a pin support 402 and secondary retaining pin 404. The pin support 402 is adapted to receive the secondary pin 404 and is secured to the pipe handling assembly 300 frame 314 proximate the discharge point 62. In the preferred embodiment, the pin support 402 is positioned adjacent the discharge point 62. A pin slot formed in the support 402 is adapted to receive the secondary pin 404. The secondary retaining pin 404 is preferably of sufficient length to cross the discharge point 62 when the pin is inserted in the slot. The secondary pin 404 is also preferably of sufficient strength to support the weight of a column of pipe sections 28 in the magazine 302.

Prior to placing a magazine 302 containing pipe section 28 on the cradle 316, a lift arm 410 of the dispensing system 310 is used to lower any pipe sections 28 at the discharge point 62 and the secondary retaining pins 404 are inserted in the pin supports 402. When the magazine 302 is place in the cradle 316, the weight on the retaining pins for the magazine will be released because the pipe sections 28 will be supported by the support members 324 and the secondary pins 404. The retaining pins for the magazine can then be removed. The lift arm 410 can then be used to raise the pipe sections 28 above the discharge point 62 off of the secondary pins 404 so the secondary pins can be removed. The pipe handling assembly 300 can then be operated normally. One skilled in the art will appreciate the pipe handling assembly 300 can be similarly used to insert the secondary pins 404 so that a full magazine 302 can be prepared for removal during a backreaming operation.

Figure 15:
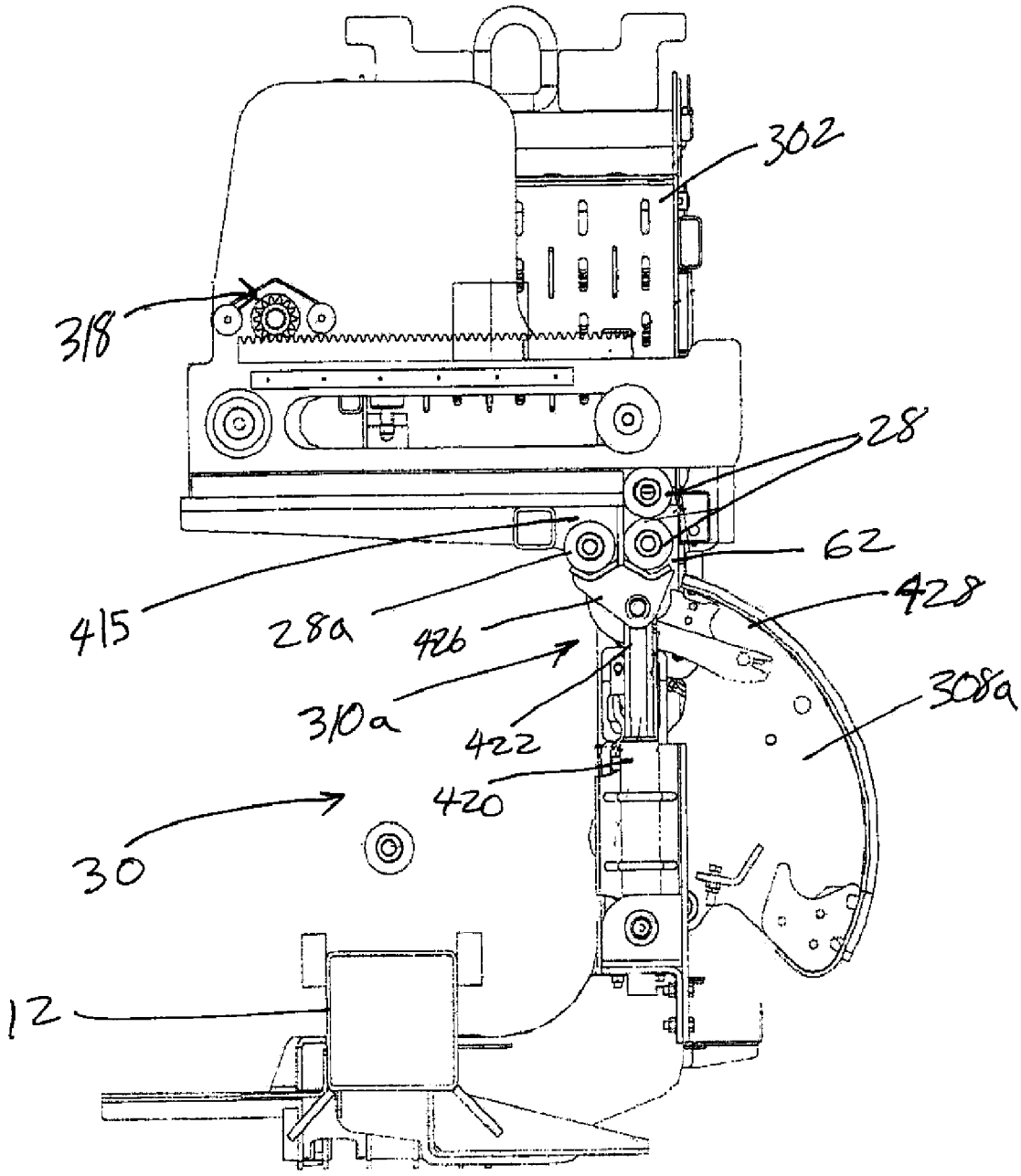
FIG. 15 is a perspective view of the pipe handling assembly of the present invention having an additional pipe storage location.

The present invention also contemplates use of a pipe handling assembly 32 (FIG. 2) or 300 (FIG. 12) to "rotate pipe" in a magazine 38 (FIG. 2) or 302 (FIG. 12) so that the same pipe section 28 is not always the lead pipe in a boring operation. With reference now to FIG. 15, shown therein is an alternative embodiment for the transfer assembly 308*a* and the dispensing system 310*a* discussed for use with the pipe handling assembly 300 of FIG. 12. The embodiment of FIG. 15 provides a storage position 415 for storage of pipe sections 28 for "rotation" in position in either the magazine or the drill string. Preferably, the storage position 415 is adjacent the discharge point 62, proximate the spindle connection area 30. Use of the storage position 415 proximate the spindle connection area 30 allows for the footprint of the machine 10 to remain small. Alternatively, the storage position 415 could be adjacent the discharge point 62 but remote from the spindle connection area 30.

In the alternative embodiment shown in FIG. 15, the dispensing system 310*a* comprises a hydraulic cylinder 420 and a lift arm 422. The lift arm 422 is movable between a plurality of positions by operation of the cylinder 420. The lift arm 422 is generally operable as the lift arm 118 discussed above with regard to FIG. 4. As shown in FIG. 15, the lift cylinder 420 is in a lift position so the lift arm 422 is extended to lift the pipe sections 28 from the discharge point 62 off of the transfer assembly 308.

The lift arm 422 comprises a pipe support 426. Preferably, the pipe support 426 is shaped to support the pipe sections 28 when lifted from the discharge point 62. More preferably, the pipe support 426 is contoured to support two adjacent pipe sections 28 and 28*a*. In this way, the lift arm 422 may lift pipe sections 28 off of the transfer member 92 and pipe sections 28*a* into the storage position 415. Likewise in reverse operation, a pipe section 28*a* can be transferred to discharge point 62 for placement in the magazine or to the drill string at the drill operator's discretion. Although the storage position 415 is shown with the embodiment of FIG. 12, one skilled in the art will recognize its adaptability to other embodiments.

Figure 16:
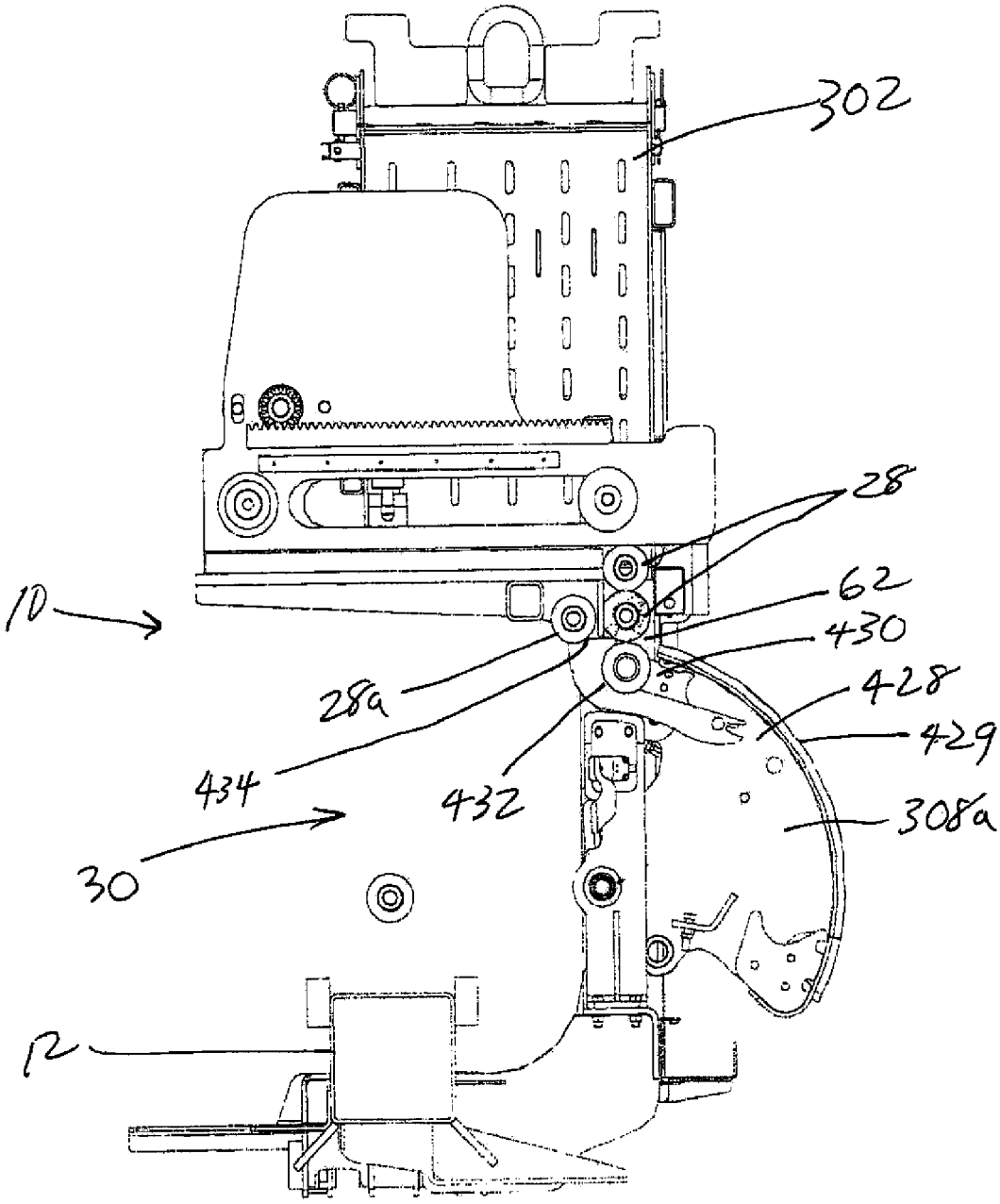
FIG. 16 is a partial perspective view of the pipe handling assembly of FIG. 15 with the lift arm in a lowered position.

Turning now to FIG. 16, the transfer assembly 308*a* for use with the storage position 415 is shown in greater detail. Similar to the transfer assembly 90 of previously discussed FIG. 3, the transfer assembly 308*a* comprises at least one transfer member 428 movably supported on the frame 12 of the machine 10 and the drive assembly (not shown) for driving the movement of the transfer member. The transfer member 428 comprises a blocking surface 429 and a pipe delivery member 430 adapted to receive and secure a pipe section 28 as the transfer member 428 moves between the discharge point 62 and the spindle connection area 30. Preferably, the delivery member 430 further comprises a pipe grip 432 operatively connected to the pipe delivery member and adapted to secure the pipe section 28 on the pipe delivery member. The pipe grip 432 may be mechanically, hydraulically, or otherwise activated to secure the pipe section 28 in the pipe delivery member 430 when the pipe section is transported between the discharge point 62 and the spindle connection area 30. The pipe grip 432 preferably comprises a blocking surface 434. The blocking surface 434 is positioned to prevent discharge of the pipe section 28*a* from the storage position 415 when the pipe delivery member is aligned with the discharge point 62, as shown in FIG. 16. Thus, when transfer member 428 is aligned with the discharge point 62, the pipe delivery member 430 can receive a pipe section 28 from the discharge point and the pipe section 28*a* in the storage position 415 is prevented from moving by the blocking surface 434. When the transfer member 428 is moved to the spindle connection area 30, the blocking surface 429 of the transfer member is aligned with the discharge point 62 and the storage position 415 to prevent discharge of pipe sections 28 and 28*a*.

Although the present invention has been described with respect to several specific preferred embodiments, various changes, modifications, and substitutions of parts and elements may be suggested to one skilled in the art. Consequently, the invention should not be restricted to the above embodiments and it is intended that the present invention encompass such changes, modifications, and substitutions of parts and elements without departing from the spirit and scope of the invention.

What is claimed is:

1. A pipe handling device for storing and transporting pipe sections to and from a drill string, the pipe handling device comprising:

a magazine having a plurality of columns adapted to receive and store pipe sections;

a cradle adapted to support the magazine;

wherein the cradle defines a discharge point proximate a bottom side of the magazine; and a transfer assembly adapted to receive a pipe section discharged from the magazine at the discharge point;

wherein the cradle is movable between a plurality of positions, the plurality of positions being defined by the position of the cradle when different columns of the magazine are aligned with the discharge point.

2. The pipe handling device of claim 1 wherein the magazine is adapted to be removed from the cradle.

3. The pipe handling device of claim 1 further comprising a drive assembly adapted to move the cradle to each of the plurality of positions.

4. The pipe handling device of claim 3 further comprising a support member having a first end and a second end;

wherein the discharge point is located at the first end of the support member; and wherein the support member prevents pipe sections from being discharged from each of the plurality of columns that stores a pipe section not aligned with the discharge point.

5. The pipe handling device of claim 4 wherein the drive assembly comprises at least one hydraulic cylinder.

6. The pipe handling device of claim 5 wherein the drive assembly further comprises:

a rack supported on the support member; and a pinion gear attached to the cradle and adapted to interface with the rack;

wherein the rack and pinion are adapted to maintain alignment of the cradle.

7. The pipe handling device of claim 4 wherein the drive assembly comprises:

a rack supported on the support member;

a pinion gear attached to the cradle and adapted to interface with the rack; and a drive motor attached to the cradle and adapted to rotate the pinion gear.

8. The pipe handling device of claim 1 wherein the transfer assembly is movable between at least a first position and a second position, the transfer assembly comprising:

a pipe delivery member; and wherein in the first position the pipe delivery member is aligned with the discharge point and in the second position the pipe delivery member is aligned with a spindle axis of the drill string.

9. The pipe handling device of claim 8 wherein the transfer assembly further comprises a pipe grip adapted to retain a pipe section on the pipe delivery member.

10. The pipe handling device of claim 1 wherein the magazine comprises:

a first end piece;

a second end piece;

at least one cross bar connecting the first piece and the second piece; and a lift bracket adapted to allow the magazine to be lifted from and placed in the cradle.

11. The pipe handling device of claim 1 further comprising:

a retaining pin; and a pin support attached to the magazine and adapted to receive the retaining pin;

wherein when the retaining pin is supported by the magazine the retaining pin is adapted to prevent pipe sections from being discharged from the column of the magazine that is aligned with the discharge point.

12. The pipe handling device of claim 1 wherein the cradle comprises at least one support pin adapted to secure the magazine to the cradle.

13. The pipe handling device of claim 1 further comprising a pipe return assembly comprising:

a lift member;

wherein operation of the lift member moves at least one of the plurality of pipe sections into the magazine from the discharge point or from the magazine to the discharge point.

14. The pipe handling device of claim 13 wherein the pipe return assembly further comprises a pipe support supported on the lift member, the pipe support adapted to support a second pipe section adjacent to the at least one of the plurality of pipe sections moved to or from the discharge point.

15. The pipe handling device of claim 14, wherein the operation of the member moves the second pipe section to or from a storage position adjacent the discharge point.

16. The pipe handling device of claim 14 wherein the transfer assembly comprises:

a transfer member pivotally movable between the discharge point and the spindle connection area;

a pipe delivery member supported on the transfer member;

a blocking surface supported on the transfer member adjacent to the pipe delivery member; and a pipe grip adapted to retain a pipe section in the pipe delivery member;

wherein the pipe grip is adapted to block discharge of a pipe section from the storage position when the pipe delivery member is aligned with the discharge point; and wherein the blocking surface is adapted to block discharge of a pipe section from the discharge point when the pipe delivery member is not aligned with the discharge point.

17. A pipe handling device for storing and transporting pipe sections to and from a drill string, the pipe handling device comprising:

a removable magazine having a plurality of columns adapted to receive and store pipe sections;

wherein the removable magazine defines a discharge point proximate a bottom side of the magazine; and a transfer assembly adapted to receive a pipe section discharged from the magazine at the discharge point;

wherein the magazine is movable between a plurality of positions, the plurality of positions being defined by the position of the magazine when different columns of the magazine are aligned with the discharge point.

18. The pipe handling device of claim 17 further comprising a drive assembly adapted to move the magazine to each of the plurality of positions.

19. The pipe handling device of claim 18 further comprising a support member having a first end and a second end;

wherein the discharge point is located at the first end of the support member; and wherein the support member prevents pipe sections from being discharged from each of the plurality of columns that stores a pipe section not aligned with the discharge point.

20. The pipe handling device of claim 19 wherein the drive assembly further comprises at least one hydraulic cylinder.

21. A method of securing and transferring pipe sections for use with a boring machine, the method comprising the steps of:

storing pipe sections in columns in a magazine that is removable from the boring machine;

lowering the magazine onto the boring machine;

moving the magazine on the machine to position a column of the magazine over a discharge point;

transferring pipe sections between the discharge point and the drill string.

* * * * *